US006551111B1

(12) United States Patent
Watanabe

(10) Patent No.: US 6,551,111 B1
(45) Date of Patent: Apr. 22, 2003

(54) ELECTRONIC EQUIPMENT

(75) Inventor: Takashi Watanabe, Tokyo (JP)

(73) Assignee: Yamatake Corporation, Tokyo (JP)

( * ) Notice: Subject to any disclaimer, the term of this patent is extended or adjusted under 35 U.S.C. 154(b) by 0 days.

(21) Appl. No.: 09/890,954

(22) PCT Filed: Feb. 15, 1999

(86) PCT No.: PCT/JP99/00647

§ 371 (c)(1),
(2), (4) Date: Aug. 8, 2001

(87) PCT Pub. No.: WO00/48273

PCT Pub. Date: Aug. 17, 2000

(51) Int. Cl.[7] ..... H01R 39/00
(52) U.S. Cl. ..... 439/11; 361/727
(58) Field of Search ..... 439/11, 534, 528, 439/341, 362, 31, 12, 18, 20, 244, 28, 716; 361/729, 331, 727, 686, 728

(56) References Cited

U.S. PATENT DOCUMENTS 4,738,632 A * 4/1988 Schmidt et al. ..... 439/341
5,253,140 A * 10/1993 Inoue et al. ..... 361/728

* cited by examiner

*Primary Examiner*—P. Austin Bradley
*Assistant Examiner*—Phuongchi Nguyen
(74) *Attorney, Agent, or Firm*—Rothwell, Figg, Ernst & Manbeck

(57) ABSTRACT

Electronic equipment includes a movable terminal block for connection of wire conductors or terminals. The terminal block is connected to a main equipment housing through a rotary connecting mechanism coupled to a sliding engagement on the main housing, such that the terminal block is movable from a side surface of the main housing to a front surface of the main housing by being rotated from the side surface to the front surface, to facilitate connection and/or disconnection of wire terminals to the terminal block.

3 Claims, 5 Drawing Sheets

FRONT FACE
1
10
8
8a
8b
5
3
3a
TOP FACE
11
2
SIDE FACE
3b
4
9a
9
3a
3
REAR FACE
BOTTOM FACE
7
6

(a)

(b)

SIDE FACE FRONT FACE (a)

(b)

ELECTRONIC EQUIPMENT

This application is the national phase under 35 U.S.C. §371 of PCT International Application No. PCT/JP99/00647 which has an International filing date of Feb. 15, 1999, which designated the United States of America and was not published in English.

TECHNICAL FIELD

This invention is related to electronic equipment having a terminal block, the setting position of which can appropriately be moved during a wiring process.

BACKGROUND ART

In factories, research facilities or the like, control devices are used for controlling various parameters such as temperature, and pressure. Such control devices include the one in which electronic equipment for controlling each parameter forms a module, and these modules are connected to each other and mounted on a DIN rail, a rack, or the like.

The electronic equipment as described above comprises a base block which is appropriately mounted on a DIN rail or a rack, and an electronic equipment body case accommodating a control circuit, and they are connected together to form a module. In such electronic equipment module, the terminal block has a power input terminal for supplying external power, and communication terminals such as an input terminal for inputting a measured observation signal, and an output terminal for outputting a control signal to control an external device based on the observation signal, and it is provided on the front face of the electronic equipment to facilitate the wiring process.

FIG. 5 is an illustration showing the conventional structure of the electronic equipment module as described above, in which (a) is a front view, (b) is a side view, and (c) is a top plan view. In the figure, 41 is the housing of the electronic equipment, which is an electronic equipment body case accommodating a control circuit or the like within it, and 42 is a base block appropriately attached to a rack or the like and having an inter-base connector 43 for connecting a plurality of modules. 43 is an inter-base connector, and between the respective connected base blocks, the internal power lines and communication lines are connected to allow power supply and sending/receiving of data between modules. 44 is a terminal block having a power input terminal, and communication terminals such as an input terminal for inputting a measured observation signal, and an output terminal for outputting a control signal to control an external device based on the observation signal, and it is placed on the front face of the electronic equipment module to make the wiring process easier. 45 is a display panel for displaying the various operation statuses of the electronic equipment module, and in the shown example, there are provided a fail display lamp 46 which illuminates when the electronic equipment module malfunctions, and an operation display lamp 47 which indicates that the electronic equipment module is in operation.

Now, a summary is made as follows. Such electronic equipment modules as described above are concatenated, and used as a control device to perform various controls with the same control panel. The concatenation of modules is carried out by mounting a plurality of base blocks 42 connected by the inter-base connector 43 on a rack or the like, and connecting the electronic equipment body case 41 of the electronic equipment modules for various control to the concatenated base blocks 42. Further, the communication cable for data transmission and reception between the controlled device that is controlled by each module, and the power cable for supplying external power are arranged on the terminal block 44 on the front face of the electronic equipment body case 41. The wiring of such cables necessary for the operation of the electronic equipment modules are performed in the terminal block 44 placed on the front face as described above, because a plurality of modules are coupled on the side, top and bottom faces, making the wiring process difficult.

Since the conventional electronic equipment is constructed as described above, the most of the front face area is occupied by the terminal block placed on the front face of the electronic equipment housing, and the area to be used for the display panel for displaying the various operation statuses of the electronic equipment cannot fully be provided. Thus, there is a problem that a display necessary for checking the control status or operation statuses of the electronic equipment may not be provided.

Specifically, in the temperature adjuster module, displays of measured temperature, preset temperature, and remote operation or local operation are essential display matters, and hence to provide a display panel for displaying all of them, it is needed to upsize the equipment housing itself to ensure the area for the front display panel. This imposes a restriction on downsizing the equipment, so there are problems such as that the installation space for such equipment cannot be effectively utilized.

This invention was accomplished to solve the above described problems, and its object is to obtain electronic equipment in which the wiring process is made easy and the area for display in the front face of the electronic equipment can be ensured by disposing a terminal block on an outer face of the electronic equipment other than the front and rear faces thereof, and appropriately moving the setting position of the terminal block to the front face for the wiring process.

DISCLOSURE OF INVENTION

The electronic equipment related to this invention includes a terminal block removably provided on an outer face of the equipment housing other than the front and rear faces thereof, and a rotary means provided at the end portion of the terminal block, and supported rotatably on the front face portion of the equipment housing so that the rear side of the terminal block engages with the front face portion of the equipment housing between the front face portion of the equipment housing and the terminal block setting portion in the outer face of the equipment housing when the terminal block is removed from the equipment housing. This allows effective use of the front face area of the equipment housing, and for instance, many parameters can be displayed by providing a large display panel, providing an effect of increasing viewability and operability. Further, since the wiring to the terminal block can be performed on the front face of the equipment housing, the wiring process is easy, and the terminal block can be placed on an outer face other than the front and rear faces of the equipment housing, so that the cable is prevented from being disconnected, providing an effect of increasing operability and safety.

The electronic equipment related to this invention has a slide means on the front face of the equipment housing, and is characterized in that a rotary means is supported on the slide means so that the terminal block is freely rotatable between the slide means and the outer face of the equipment housing, on which the terminal block is placed, when the terminal block is removed from the equipment housing, and that the terminal block is allowed to move to the front face of the equipment housing via the rotary means by the slide means when removed from the equipment housing.

Since this enables the wiring to the terminal block to be carried out on the front face of the equipment housing, the wiring process is easy, and the cable is prevented from being disconnected during the working on the front face of the equipment housing, because the terminal block can be placed on an outer face other than the front and rear faces of the equipment housing when the process is completed, providing an effect of increasing operability and safety.

The electronic equipment related to this invention has a terminal block fixing means shaped in a projection on one of the front face of the equipment housing and the terminal block and has a terminal block fixing means shaped in a recess on the other one, and is characterized in that the terminal block is fixed at the front face of the equipment housing by the terminal block fixing means.

This produces an effect that the wiring to the terminal block on the front face of the equipment housing can be performed in a stabler condition.

BEST MODE FOR CARRYING OUT THE INVENTION

Now, to describe this invention in more detail, the best mode for carrying out this invention is described according to the accompanying drawings.

Mode 1 for Carrying Out the Invention

Figure 1:
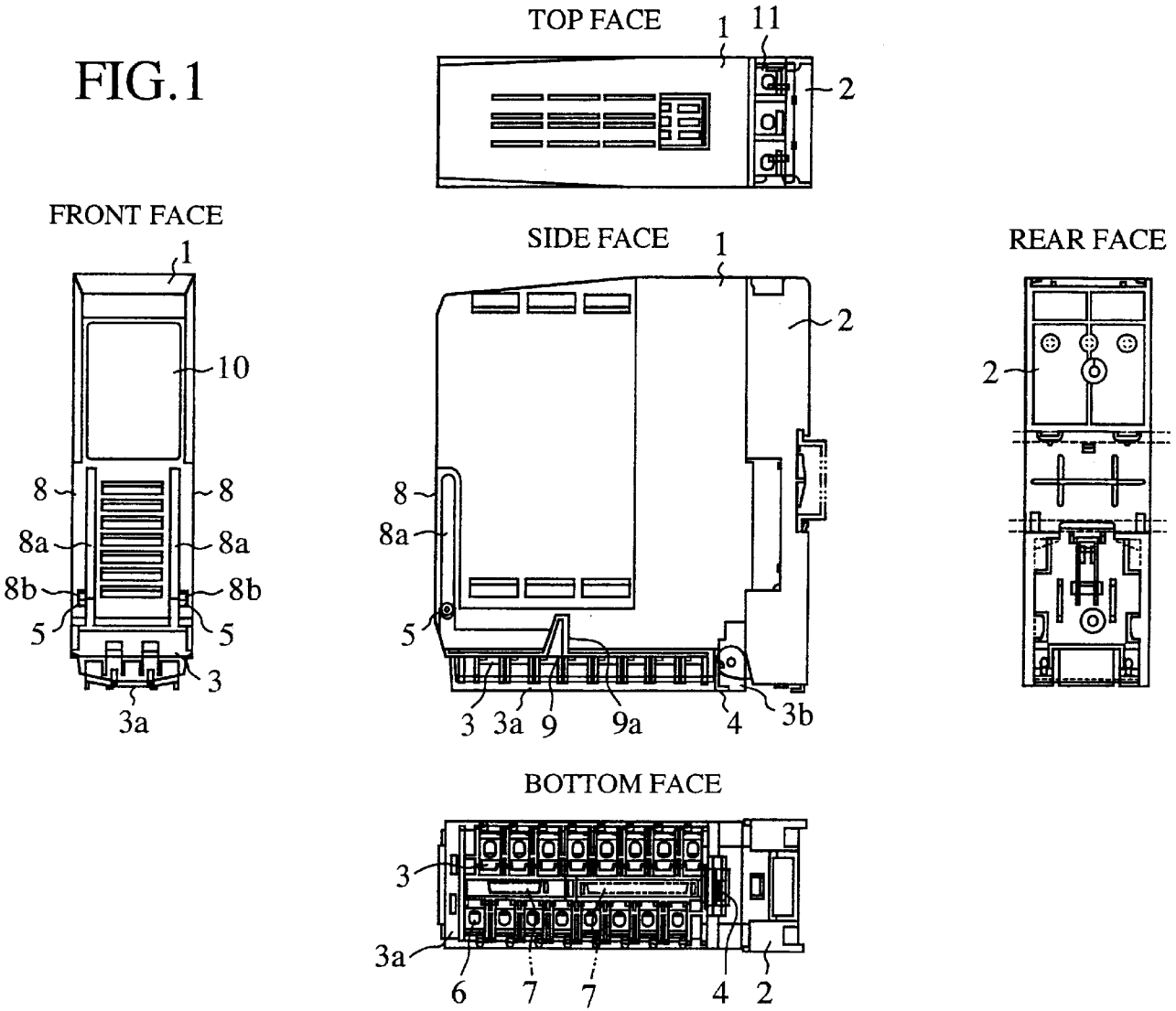
FIG. 1 is an illustration of five views showing the external appearance of the electronic equipment according to the mode 1 for carrying out the present invention.

FIG. 1 is an illustration of five views showing the external appearance of the electronic equipment according to the mode 1 for carrying out this invention, in which the front and rear faces, the top and bottom faces, and one side face are shown. In the figure, 1 is an electronic equipment body case (equipment housing) accommodating a control circuit board, and 2 is a base block (equipment housing) which is appropriately attached to a rack or the like; the electronic equipment body case 1 and the base block 2 are connected together to form an electronic equipment module. 3 is a terminal block, which has input/output terminals 6 for wiring a power cable for supplying external power, and the like, and connectors 7 to which cables having a specific connector are connected, and it is disposed on the bottom face of the electronic equipment body case 1 and electrically connected to the external electrode connecting portion of the above control circuit board, not shown, which is exposed to the outside of the electronic equipment body case 1, 3*a* is a terminal cover for protecting the input/output terminals of the terminal block 3, and it is supported on the electronic equipment body case 1 by a cover rotary means 3*b* so as to be freely rotatable between the terminal block 3 and its downward direction. 4 is a case fixing latch for fixing the terminal block 3 to the electronic equipment body case 1, and 5 is a terminal block rotary portion (rotary means) provided at the end portion of the terminal block 3, and supported by a slide rail 8*a* in a terminal slide means 8 so that the terminal block 3 is freely rotatable between the terminal slide means 8 and the face of the electronic equipment body case 1 on which the terminal block 3 is set.

6 is an input/output terminal for cabling provided in the terminal block 3, and 7 is a connector for connecting a cable having a specific connector. 8 is a terminal slide portion (slide means) provided on the front face of the electronic equipment body case 1, and 8*a* is a slide rail (slide means) for supporting the terminal block rotary portion 5. In the slide rail 8*a*, there is provided an engagement recess for terminal block fixing (terminal block fixing means shaped in a recess) 8*b* in which an engagement projection for fixing (terminal block fixing means shaped in a projection) 9 provided at both sides of the terminal block 3 and projecting to the rear side of the terminal block 3 is fixedly engaged. 9*a* is the case side engagement portion with which the above engagement projection for fixing 9 engages when the terminal block 3 is fixed at the normal setting position in the electronic equipment body case 1. 10 is a display panel that displays various operation statuses of the electronic equipment of this invention, and it is provided in the front face of the electronic equipment body case 1. 11 is a power input terminal provided in the top face of the electronic equipment body case 1, to which a power cable for external power supply is wired.

Figure 2:
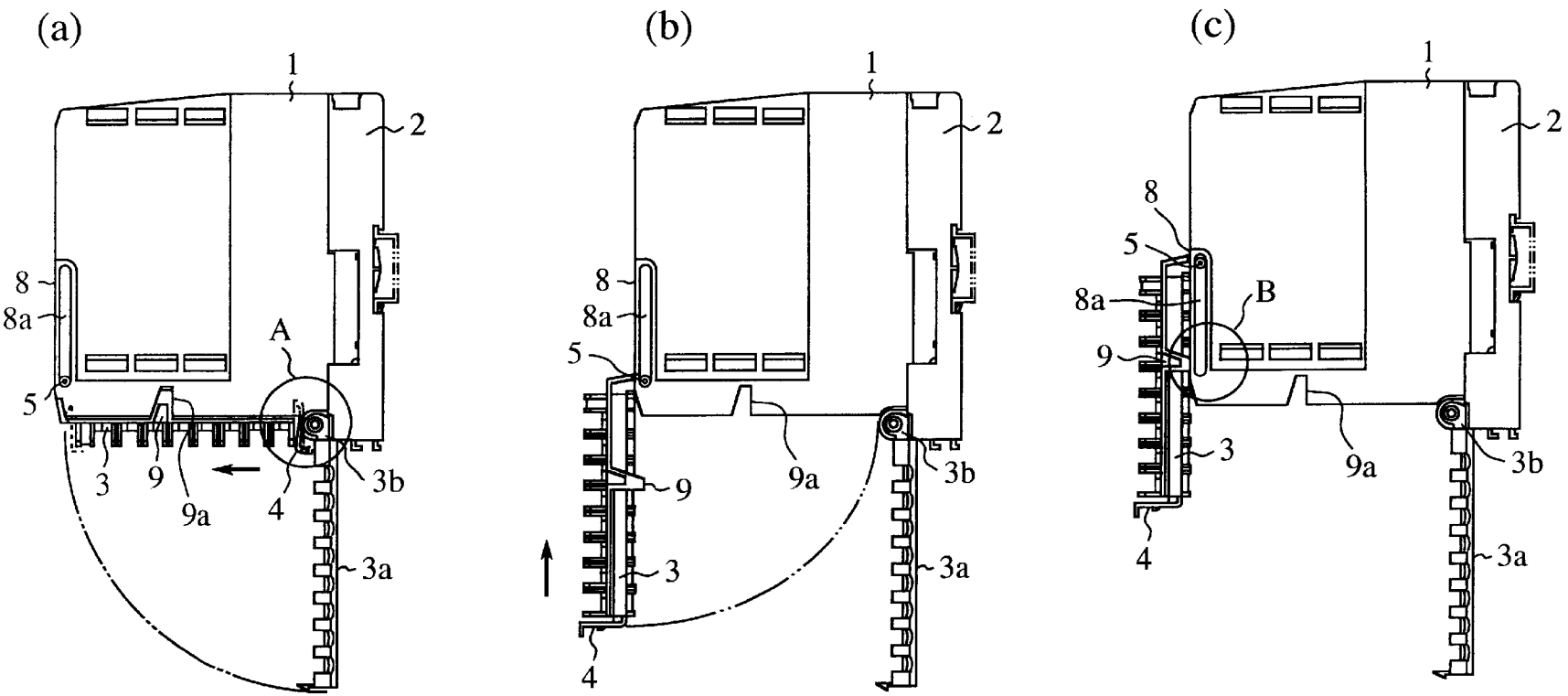
FIG. 2 is an explanatory view for explaining the movement of the terminal block of the electronic equipment according to the mode 1 for carrying out this invention.
Figure 3:
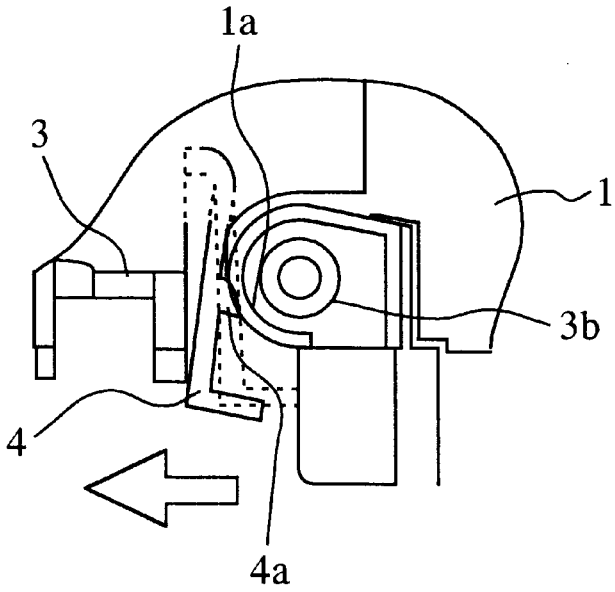
FIG. 3 is an illustration showing the structural part of the terminal block of the electronic equipment according to the mode 1 for carrying out the invention, in which (a) is an enlarged view of the portion A in (a) of FIG. 2, and (b) shows an enlarged view of the portion B in (c) of FIG. 2 along with a front view of that portion.
Figure 3:
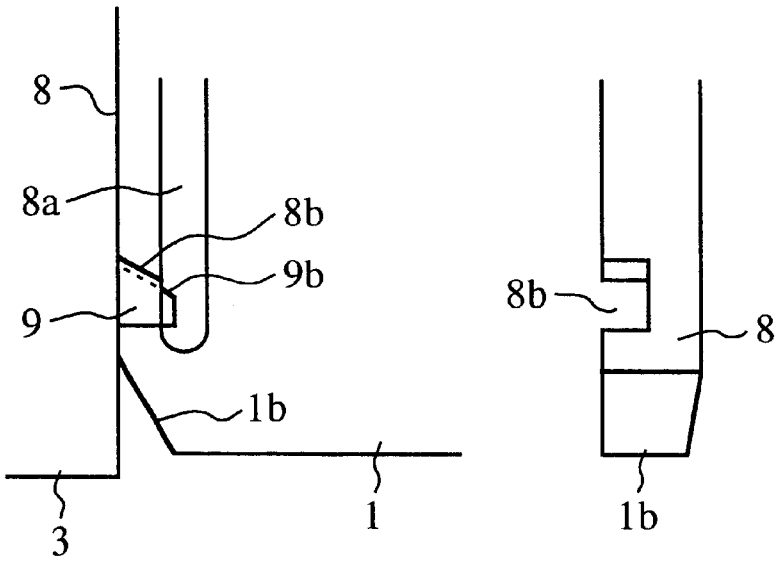

FIG. 2 is an explanatory view explaining the movement of the terminal block of the electronic equipment according to the mode 1 for carrying out this invention, and the terminal block moves to the front face of the electronic equipment body case 1 in the sequence of (a), (b) and (c) in the figure. FIG. 3 is an illustration showing the structural portion of the terminal block of the electronic equipment according to the mode 1 for carrying out this invention, in which (a) shows an enlarged view of the portion A in (a) of FIG. 2, and (b) shows an enlarged view of the portion B in (c) of FIG. 2 along with a front view of that portion. In addition, the portions same as those shown in FIG. 1 are similarly designated to omit duplicated description.

Using FIG. 2, the operation for moving the terminal block 3 to the front face of the electronic equipment body case 1 is described. To wire a cable or the like to the terminal block 3, first, the terminal cover 3*a* protecting the input/output terminals 6 of the terminal block 3 is pivoted about the cover rotary portion 3*b* provided at the end portion thereof to release the protection of the input/output terminals 6, as shown in FIG. 2(*a*). Then, when the case fixing latch 4 is pulled towards the front face of the body case 1, the fixing of the terminal block 3 to the body case 1 is released. As shown in FIG. 3(*a*), in the case fixing latch 4, the engagement projection 4*a* provided in the case fixing latch 4 and the case side engagement recess 1*a* provided opposite to the case fixing latch 4 are fixedly engaged each other when the terminal block 3 is fixed to the body case 1, and the fixed engagement can be released by pulling the latch 4 towards the front face of the body case 1 when removing the terminal block 3.

When the fixing to the body case 1 is released, the terminal block 3 is freely removable from the body case 1, because the terminal block 3 is connected, for free disconnection, to the external electrode connector portion of the control circuit board, not shown, which is housed in the body case 1. Then, when the terminal block 3 is removed from the body case 1, the terminal block 3 pivots about the terminal rotary portion 5 provided at the other end portion, between the terminal slide portion 8 and the setting surface of the terminal block 3 of the electronic equipment body case 1, and it is suspended by the slide rail 8*a* (refer to FIG. 2(*b*)).

Next, the terminal rotary portion 5 is slid in the upward direction of the body case 1 within the slide rail 8*a* to set the terminal block 3 with the rear side thereof being engaged with the front face portion of the body case 1. Specifically, by fixedly engaging the engagement projection 9 for fixing provided on both sides of the terminal block 3 and projecting to the rear side of the terminal block 3 with the engagement recess 8*b* for terminal fixing provided in the slide rail 8*a*, the terminal block 3 is set and fixed on the front face of the body case 1.

To describe in detail the fixing of the terminal block 3 to the front face of the body case 1, the engagement projection 9 for fixing projecting to the rear side of the terminal block 3 has a slope surface 9*b* which lowers towards the rear of the body case 1, as shown in FIG. 3(*b*), and the front lower portion of the body case 1 has a slope surface 1*b* which rises in the forward direction. As the terminal block 3 is slid to the front face of the body case 1, the engagement projection 9 for fixing is brought in contact with the front lower portion of the body case 1. At this point, since the slope surfaces 9*b* and 1*b* are formed as described above, the engagement projection 9 for fixing can be upwardly slid without a large abrasive resistance being felt. When the engagement projection 9 for fixing reaches the engagement recess 8*b* for terminal fixing provided in the slide rail 8*a*, these are fixedly engaged. The engagement recess 8*b* for terminal fixing becomes narrower towards the rear of the body case 1 in conformity with the shape of the engagement projection 9 for fixing, and this causes little gap between the engagement recess 8*b* for terminal fixing and the engagement projection 9 for fixing when they are engaged, so the terminal block 3 can be set without play.

Since the terminal block 3 is set and fixed with the rear side of thereof being engaged with the front face of the body case 1 as described above and the wiring process is performed, the process can be easily performed. After the wiring process, by pulling the terminal block 3 in forward direction of the body case 1, the fixed engagement between the engagement projection 9 for fixing and the engagement recess 8*b* for terminal fixing is released, and the terminal block 3 is suspended by the slide rail 8*a*. Thereafter, by performing the above operation in reverse, the terminal block 3 is set on the underside of the body case 1, and the terminal cover 3*a* is replaced, completing the wiring process. Further, even if a cable having a special connector is connected to the terminal block 3, the cable does not appear on the front face of the body case 1, so the cable is not disconnected during the equipment operation on the front face of the body case 1.

Further, since the terminal block slide portion 8 can be set on both sides of the front face of the body case 1, it does not occupy a large area, so the display panel area can be ensured in electronic equipment required to display many parameters.

Furthermore, in the above described terminal block slide portion 8, the terminal rotary portion 5 is not inserted into the slide rail 8*a* from the side face of the electronic equipment body case 1, but it is inserted from a groove on the front face side of the side rail 8*a*, which is a groove provided in the front and side faces of the electronic equipment body case 1, so there is no projection on the side face of the electronic equipment body case 1, and the installation space for connecting electronic equipment modules can be effectively used.

As described above, in accordance with the mode 1 for carrying out the invention, a construction is provided in which a terminal block is removably provided on an outer face rather than the front and rear faces of the electronic equipment body case, and the terminal block is moved to the front face of the electronic equipment body case by a terminal block slide means and fixedly set during the wiring process to the terminal block, so the front face area of the electronic equipment body case can be effectively utilized, and for instance, many parameters can be displayed by providing a large display panel, thereby increasing viewability and operability.

Moreover, since the wiring process to the terminal block can be carried out on the front face of the electronic equipment body case, the process is easy, and since the terminal block can be placed on an outer face rather than the front and rear faces of the electronic equipment body case after the process is completed, there is no fear that the cable is removed during the operation at the front face of the electronic equipment body case, increasing operability and safety.

In addition, the above description has been made to the case in which the wiring is made to the terminal block 3, but, for a cable such as power cable which causes danger if wrongly wired, a power input terminal dedicated to the power cable for external power supply may be provided independently of the terminal block 3, as shown in the top plan view in FIG. 1, so as to be separated from other cables for preventing wrong wiring.

Figure 4:
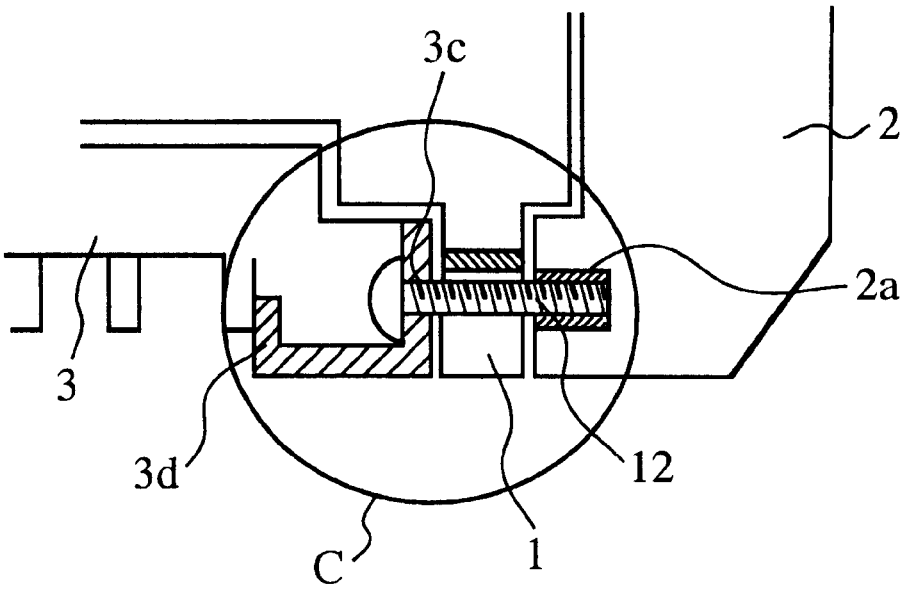
FIG. 4 is an illustration showing the terminal block of the electronic equipment according to the mode 1 for carrying out this invention when it is screwed and fixed to the base block, in which (a) is a cross-sectional side view of the screwed portion of the terminal block between the base block, and (b) is an enlarged view of the portion C in (a)
Figure 4:
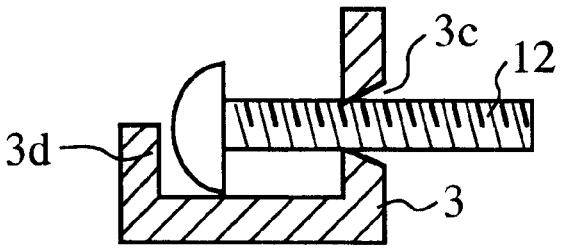
Figure 5:
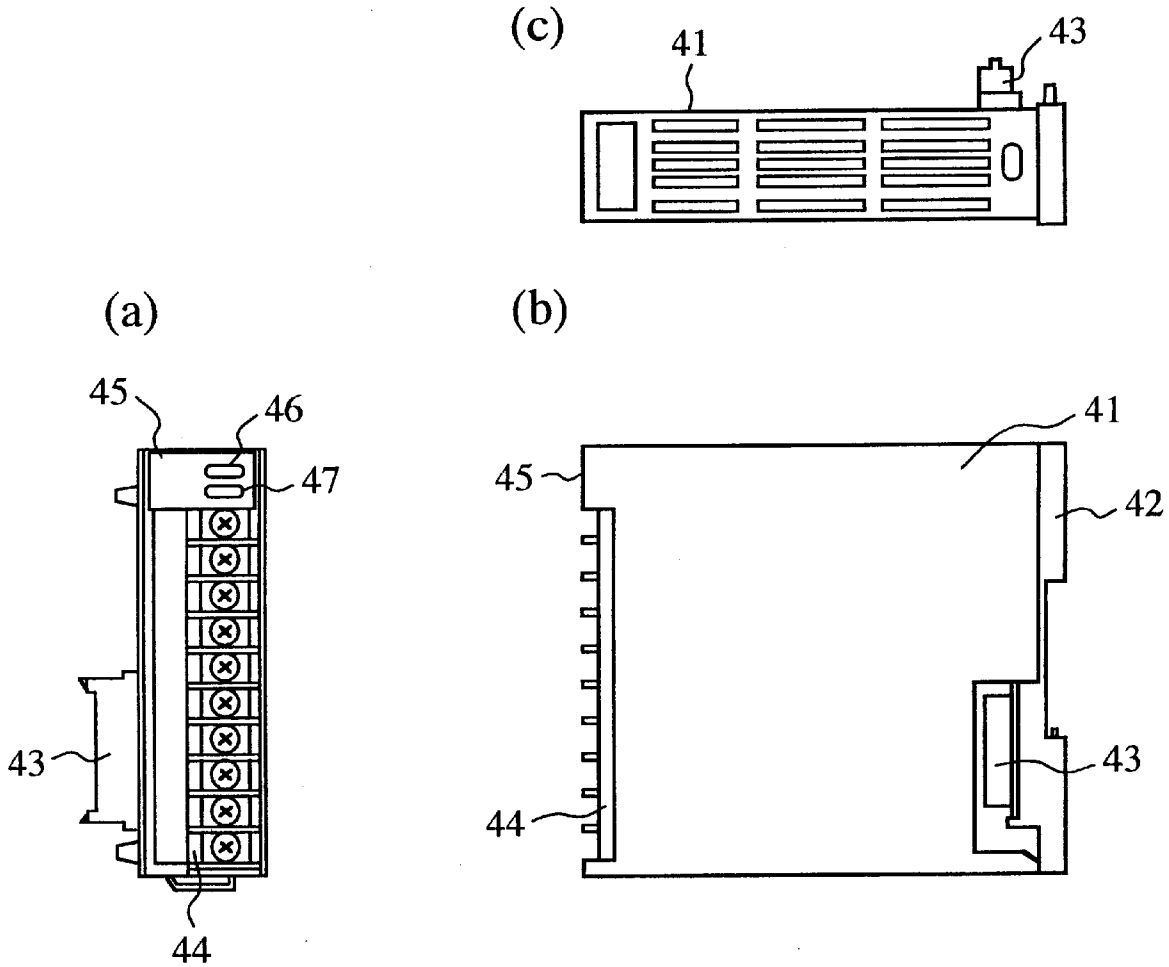
FIG.5 CONVENTIONAL ART
FIG. 5 is an illustration showing the construction of the conventional electronic equipment, in which (a) is a front view, (b) is a side view, and (c) is a top plan view.

Further, in the foregoing, the fixing of the terminal block 3 to the body case 1 is performed by the case fixing latch 4, but the terminal block 3 may be directly screwed to the body case 1 or the like. FIG. 4 is a figure showing the case in which the terminal block 3 of the electronic equipment according to the mode 1 for carrying out the invention is fixedly screwed to the base block 2, in which (a) is a cross-sectional side view of the screwed portion of the terminal block 3 with the base block 2, and (b) is an enlarged view of the portion C in (a). In the figure, 12 is a supporting and fixing screw for screwing the end portion of the terminal block 3 to the base block 2, 3*c* is the through hole for the supporting and fixing screw 12, which is provided in the end portion of the terminal block 3, and 3*d* is a screw stopper with which the head of the supporting and fixing screw 12 having passed through the through hole 3*c* contacts when it advances by a certain length, thereby preventing the screw 12 from coming out. 2*a* is a screw hole which the screw 12 provided in the base block 2 threads into. The portions same as those shown in FIG. 1 are designated the same symbols to omit duplicated description.

As shown in FIG. 4(*a*), the terminal block 3 is screwed to the base block 2 by the supporting and fixing screw 12 having passed through the through hole 3*c*. The through hole 3*c* has an inner diameter giving almost no gap between the outer diameter of the screw 12, as shown in FIG. 4(*b*). This allows the screw 12 to be in contact with and loosely held by the through hole 3*c* even if the terminal block 3 is suspended by the slide rail 8*a*, as shown in FIG. 2(*b*), whereby the screw 12 does not completely fall in the downward direction. Thus, it is not needed to draw back the screw 12 when the terminal block 3 is screwed again to the base block 2, so that the screwing process can easily be started.

Although the above description has been made to a case in which the terminal block 3 removed from the body case 1 is suspended in the slide rail 8*a* by the terminal rotary portion 5, the terminal block 3 may be removably supported in the slide rail 8*a*. This allows the terminal block 3 to be completely removed from the body case 1, so there is no limitation due to the setting position of the terminal block 3 during the wiring process and a wide working space can be ensured, making the process easy.

In the mode 1 for carrying out the invention described above, a case has been shown in which the terminal block 3 removed from the body case 1 is moved to the front face of the electronic equipment body case 1 by the terminal slide portion 8 provided in the front face, but, if a bearing portion is provided in the front face portion of the body case 1 to support the terminal rotary portion 5 of the terminal block 3, then the terminal block 3 is suspended in the front face of the body case 1, and thus the wiring to the terminal block 3 can be performed on the front face of the body case 1, so the same effect as the above can be obtained. Further, by providing a fixing means for terminal fixing block in the vicinity of the bearing portion for the terminal rotary portion 5 that is provided in the front face of the body case 1, the suspended terminal block 3 is fixed in this condition, and the wiring process can be performed in a stabler condition.

INDUSTRIAL APPLICABILITY

As described above, in the electronic equipment related to this invention, the terminal block is disposed on an outer face rather than the front and rear faces of the electronic equipment housing, and by appropriately moving the setting position of the terminal block to the front face in the wiring process, the wiring process is made easy, and the display area in the front face of the equipment can be assured.

What is claimed is:

1. Electronic equipment, comprising:

a main body case having a front face, a rear face, and side faces adjacent to said front and rear faces;

a base block located on said rear face of said main body case and mounting said main body case;

a terminal block having a plurality of terminals for connecting conductors to said main body case; and a rotary portion provided between said main body case and an end portion of said terminal block for movably supporting said terminal block from one of said side faces to said front face;

wherein said terminal block moves so that a face of said plurality of terminals is substantially parallel to one of said side faces when said terminal block is supported at said one of said side faces, and the face of said plurality of terminals is substantially parallel to said front face so as to allow connection of said conductors when said terminal block is supported at said front face;

said electronic equipment further comprising a slide means in the front face portion of said main body case, wherein said rotary portion is supported by said slide means so that said terminal block is freely rotatable between the surface of said one of said side faces of said main body case, and said front face of said main body case by said slide means through said rotary portion.

2. Electronic equipment as set forth in claim 1, wherein one of the front face of said main body case and said terminal block has a terminal block fixing means shaped as a projection while the other of said front face and said terminal block has a terminal block fixing means shaped as a recess, and said terminal block is fixed by said terminal block fixing means in the front face of said main body case.

3. An electronic module, comprising:

a main body having a front face, a rear face, and side faces adjacent to said front and rear faces;

a base block located on said rear face of said main body, and which attaches to a mounting rack for mounting a plurality of electronic modules thereon;

a terminal block having a plurality of terminals for connecting conductors from electronic devices to said main body, said terminal block being movably provided on one of said side faces, said terminal block having a rotary connection to said front face such that said terminal block is movable from said one side face to said front face, said terminal block being movable to said front face when said module is mounted on said mounting rack to provide access to said plurality of terminals, whereby said plurality of terminals face in a direction coincident with said front face to allow connection of a conductor from an electronic device to said terminal block, and said terminal block being moved back to said side face subsequent to connection of said conductor, such that said plurality of terminals face in a direction that is not coincident with said front face when said terminal block is mounted on said one side face.

* * * * *